US010202253B2

(12) United States Patent
Koskol

(10) Patent No.: US 10,202,253 B2
(45) Date of Patent: Feb. 12, 2019

(54) METHOD FOR WINDING AN ELASTIC YARN PACKAGE

(71) Applicant: INVISTA North America S.à r.l., Wilmington, DE (US)

(72) Inventor: Joseph E. Koskol, Wilmington, DE (US)

(73) Assignee: INVISTA North America S.à r.l., Wilmington, DE (US)

( * ) Notice: Subject to any disclaimer, the term of this patent is extended or adjusted under 35 U.S.C. 154(b) by 355 days.

(21) Appl. No.: 14/398,937

(22) PCT Filed: Mar. 26, 2013

(86) PCT No.: PCT/US2013/033859

§ 371 (c)(1),
(2) Date: Nov. 4, 2014

(87) PCT Pub. No.: WO2013/151829

PCT Pub. Date: Oct. 10, 2013

(65) Prior Publication Data

US 2015/0136893 A1 May 21, 2015

Related U.S. Application Data

(60) Provisional application No. 61/620,794, filed on Apr. 5, 2012.

(51) Int. Cl.
*B65H 54/40* (2006.01)
*B65H 54/38* (2006.01)

(52) U.S. Cl.
CPC ..... *B65H 54/40* (2013.01); *B65H 54/385* (2013.01); *B65H 2701/319* (2013.01)

(58) Field of Classification Search
CPC .... B65H 54/38; B65H 54/381; B65H 54/383; B65H 54/385; B65H 54/386; B65H 2701/319
See application file for complete search history.

(56) References Cited

U.S. PATENT DOCUMENTS 3,638,872 A 2/1972 Jennings
4,136,836 A 1/1979 Akers
(Continued)

FOREIGN PATENT DOCUMENTS

JP 62-240266 A 10/1987
WO 2011/053767 A2 5/2011
WO 2013/151829 A1 10/2013

OTHER PUBLICATIONS

International Search Report and Written Opinion Received for PCT Application No. PCT/US2013/033859, dated Jul. 1, 2013, 10 pages.
(Continued)

*Primary Examiner* — William E Dondero
(74) *Attorney, Agent, or Firm* — Bridget C. Sciamanna; Kathleen A. Tyrrell

(57) ABSTRACT

A method is provided for winding an elastic yarn into a cylindrical substantially straight-ended yarn package. The method includes feeding an elastic or elastomeric yarn at a substantially constant speed to a tube core to form the yarn package. The yarn package is rotated such that the yarn package with a substantially constant surface speed. The yarn is wound to form layers of helical coils, while providing a helix angle variation of greater than zero up to +/−80%.

8 Claims, 3 Drawing Sheets

(56) References Cited

U.S. PATENT DOCUMENTS

| | | | | |
|---|---|---|---|---|
| 4,280,667 | A | 7/1981 | Akers | |
| 4,688,734 | A * | 8/1987 | Correll, Jr. | B65H 51/16 242/418 |
| 5,727,744 | A * | 3/1998 | Threlkeld | B65H 54/20 242/477.6 |
| 2007/0117953 | A1 * | 5/2007 | Palmer, Jr. | C08G 18/10 528/85 |
| 2011/0203964 | A1 | 8/2011 | Koskol | |

OTHER PUBLICATIONS

International Preliminary Report and Patentability Report Received for PCT Patent Application No. PCT/US2013/033859, dated Oct. 16, 2014, 9 pages.

* cited by examiner

METHOD FOR WINDING AN ELASTIC YARN PACKAGE

FIELD OF THE INVENTION

The invention related to a method of winding elastic yarn packages, such as spandex yarn packages, including a high helix angle variation. This method reduced running bands on unwinding of the yarn packages.

BACKGROUND OF THE TECHNOLOGY

Yarn package unwind performance is adversely impacted by formation of running bands which lead to fabric defects and yarn breaks. Higher levels of running bands lead to higher levels of fabric defects and yarn breaks. Moreover, running bands are aesthetically bad in that a customer would rate a running band free package as more desirable.

Running bands include masses of individual threadline reversals which have been dislodged inwardly from their winding position at the edge of the package due to the action of the unwind rollers. Keeping the reversals in their original position in the package is preferred to prevent an uncontrolled mass of dislodged reversals. The package edge, also referred to as the shoulder, tends to be higher than the center of the package due to the additional yarn deposited in the reversal as the traverse guide slows down, changes direction, and then speeds up again during winding of a yarn package.

During unwinding of a yarn package, the raised package shoulders allow unwinding rollers to focus their driving forces into this area tending to dislodge reversals. Furthermore, the raised package shoulders have a sloped profile which causes or promotes the additional dislodging of reversals.

One method for winding a yarn package is disclosed in U.S. Pat. No. 3,638,872, incorporated by reference herein, in its entirety. The method includes winding a hard yarn such as nylon onto a package, which reduces ribbon formation by periodically decreasing the rate of the peripheral package winding speed coincidently with and proportional to a periodic increase in traverse rate.

SUMMARY OF THE INVENTION

Flattening the surface profile of the package will reduce the energy that the unwind rollers can impart to the package shoulders by more uniformly driving the entire surface of the package and will also reduce the sloped profile of the shoulder. Winders typically have the ability to provide a function which slightly increases and slightly decreases the winding helix angle (angle of yarn with respect to the circumference of the package) by slightly increasing and slightly decreasing the traverse guide speed in a saw-tooth pattern, with the purpose of breaking up ribbons which are unacceptable masses of overlapping yarn wraps that that would otherwise form if the package revolutions per minute remained an exact multiple of the traverse guide cycles per minute. This increase and decrease of the helix angle has a side effect which is that the laydown width of the yarn wave slightly decreases and slightly increases inversely to the helix angle change. This helix angle variation, if run at high amplitudes, can be used to sufficiently vary the yarn laydown width to distribute the reversals axially to lower the package shoulder, reduce the shoulder slope, and flatten the package, thus minimizing or eliminating running band formation during unwind.

In some aspects is a method for winding an elastic yarn into a cylindrical substantially straight-ended yarn package including:

(a) feeding a spandex yarn at a substantially constant speed to a tube core to form said yarn package;
(b) rotating the yarn package to provide the yarn package with a substantially constant surface speed; and
(c) winding the spandex yarn to form layers of helical coils, while providing a helix angle variation of greater than zero up to +1-80%.

In another aspect is a yarn package including layers of a helically wound spandex yarn including a helix angle variation of about +/−3% to about +/−50%. These spandex yarn packages include a flatter package profile compared to those have a smaller or no helix angle variation. On unwinding, these yarn packages produce fewer running bands which can cause yarn breaks and fabric defects.

DETAILED DESCRIPTION OF THE INVENTION

Figure 1:
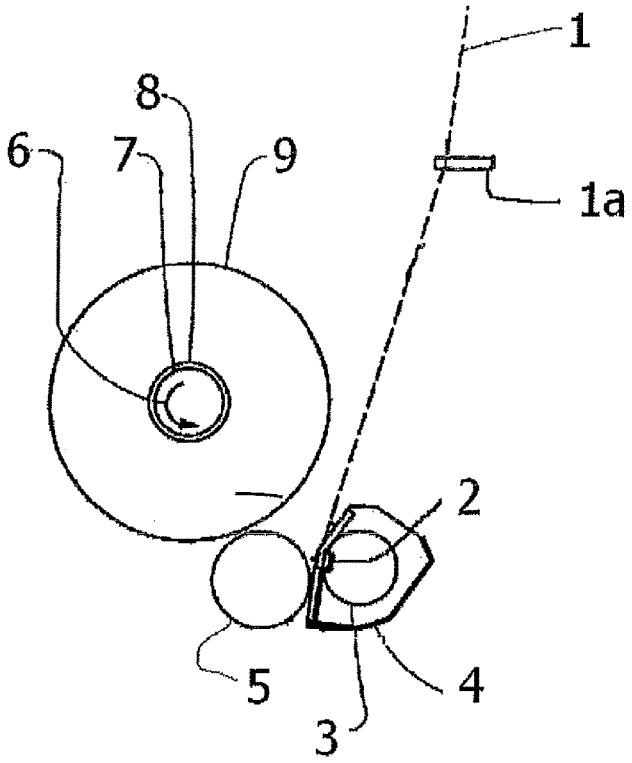
FIG. 1 is a side view of yarn being wound onto a yarn package.

As shown in FIG. 1, the windup shown for illustrative purposes includes a tube core 8 on a chuck 7 onto which the threadline 1 is transferred through a fanning guide 1*a* (optional) to the traverse assembly including traverse guide 2, cam barrel 3, and cam housing and rails 4 to the contact roll 5 which transfers the threadline to the tube core to form the yarn package 9. The direction of rotation 6 of the package 9 is indicated.

The spandex threadline 1 is deposited on the package in helical coils at an angle determined by the speed of the traverse guide 2. While a yarn package may typically use a variation helix angle of +/−2.5%, the helix angle variation of some aspects is greater than zero up to about +/−80%. Another aspect includes a helix angle variation of about +/−3% to about +/−80%. Other aspects include a helix angle variation is about +/−3% to about +/−50%; and helix angle variation is about +/−5% to about +/−30%.

Figure 2:
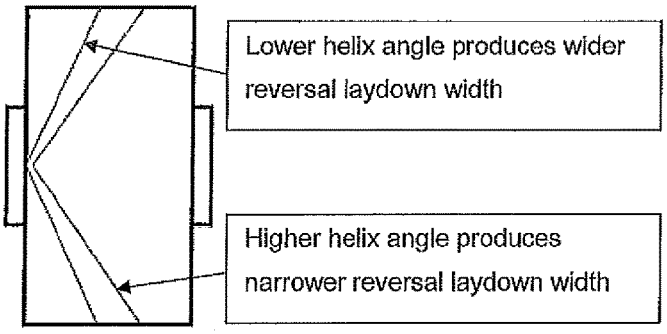
FIG. 2 is a diagram of the winding process with a lower helix angle producing wider reversal laydown width and a higher helix angle produces narrower reversal laydown width.

The winding process includes a base angle from which the helix angle variation is applied to provide a range of helix angles through which yarn is deposited onto the package. One suitable range of base angle is about 5° to about 30°; another example for a base angle is about 10° to about 15°. The helix angle is varied in part due to the change of rate of oscillation of the traverse guide. The full cycle of variation may be completed in any desired time such as about 5 seconds to about 5 minutes, including about 20 seconds to about 2 minutes, depending on the type of yarn and denier of the yarn. See FIG. 2.

The helix angle variation provides a range of helix angles as needed to achieve the desired reduction in package shoulders. Suitable ranges of helix angles include about 10° to about 20° and about 8° to about 18°, among others. Accordingly, some aspects achieve a yarn package which includes a reduction in raised package shoulders compared to a yarn package prepared with a zero helix angle variation or with a smaller helix angle variation. On unwinding, the packages exhibit fewer running bands compared to a yarn package prepared with a zero helix angle variation or with a smaller helix angle variation. In general, an increase in helix angle variation provides a reduction in running bands on unwinding to a limit which will vary depending on a number of factors such as the type of yarn and denier of the yarn.

A variety of different elastic or elastomeric fibers are useful with the present invention. Suitable elastomeric yarns include as well as elastomeric yarns such as rubber filament, bicomponent and elastoester, lastol and spandex. The yarn may be of any suitable denier including 20 denier, 40 denier, and 70 denier, ranging up to 620 denier or greater.

Where the elastomeric yarn is a spandex, it may be wet-spun or dry-spun from a polyurethane or polyurethaneurea and may have a single component or multiple component cross-section, such as sheath-core or side-by-side.

Polyurethane or polyurethaneurea compositions useful for preparing fiber or long chain synthetic polymers that include at least 85% by weight of a segmented polyurethane. Typically, these include a polymeric glycol or polyol which is reacted with a diisocyanate to form an NCO-terminated prepolymer (a "capped glycol"), which is then dissolved in a suitable solvent, such as dimethylacetamide, dimethylformamide, or N-methylpyrrolidone, and then reacted with a difunctional chain extender. Polyurethanes are formed when the chain extenders are diols (and may be prepared without solvent). Polyurethaneureas, a sub-class of polyurethanes, are formed when the chain extenders are diamines. In the preparation of a polyurethaneurea polymer which can be spun into spandex, the glycols are extended by sequential reaction of the hydroxy end groups with diisocyanates and one or more diamines. In each case, the glycols must undergo chain extension to provide a polymer with the necessary properties, including viscosity. If desired, dibutyltin dilaurate, stannous octoate, mineral acids, tertiary amines such as triethylamine, N,N'-dimethylpiperazine, and the like, and other known catalysts can be used to assist in the capping step.

Suitable polyol components include polyether glycols, polycarbonate glycols, and polyester glycols of number average molecular weight of about 600 to about 3,500. Mixtures of two or more polyols or copolymers can be included.

Examples of polyether polyols that can be used include those glycols with two or more hydroxy groups, from ring-opening polymerization and/or copolymerization of ethylene oxide, propylene oxide, trimethylene oxide, tetrahydrofuran, and 3-methyltetrahydrofuran, or from condensation polymerization of a polyhydric alcohol, such as a diol or dial mixtures, with less than 12 carbon atoms in each molecule, such as ethylene glycol, 1,3-propanediol, 1,4-butanediol, 1,5-pentanediol 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. A linear, bifunctional polyether polyol is preferred, and a poly(tetramethylene ether) glycol of molecular weight of 0.4 about 1,700 to about 2,100, such as Terathane® 1800 (INVISTA of Wichita, Kans.) with a functionality of 2, is one example of a specific suitable polyol. Co-polymers can include poly(tetramethylene-co-ethyleneether) glycol.

Examples of polyester polyols that can be used include those ester glycols with two or more hydroxy groups, produced by condensation polymerization of aliphatic polycarboxylic acids and polyols, or their mixtures, of low molecular weights with no more than 12 carbon atoms in each molecule. Examples of suitable polycarboxylic acids are malonic acid, succinic acid, glutaric acid, adipic acid, pimelic acid, suberic acid, azelaic acid, sebacic acid, undecanedicarboxylic acid, and dodecanedicarboxylic acid. Examples of suitable polyols for preparing the polyester polyols are ethylene glycol, 1,3-propanediol, 1,4-butanediol, 1,6-pentanediol 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. A linear bifunctional polyester polyol with a melting temperature of about 5° C. to about 50° C. is an example of a specific polyester polyol.

Examples of polycarbonate polyols that can be used include those carbonate glycols with two or more hydroxy groups, produced by condensation polymerization of phosgene, chloroformic acid ester, dialkyl carbonate or diallyl carbonate and aliphatic polyols, or their mixtures, of low molecular weights with no more than 12 carbon atoms in each molecule. Examples of suitable polyols for preparing the polycarbonate polyols are diethylene glycol, 1,3-propanediol, 1,4-butanediol, 1,5-pentanediol, 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. A linear, bifunctional polycarbonate polyol with a melting temperature of about 5° C. to about 50° C. is an example of a specific polycarbonate polyol.

The diisocyanate component can also include a single diisocyanate or a mixture of different diisocyanate including an isomer mixture of diphenylmethane diisocyanate (MDI) containing 4,4'-methylene bis(phenyl isocyanate) and 2,4'-methylene bis(phenyl isocyanate). Any suitable aromatic or aliphatic diisocyanate can be included. Examples of diisocyanates that can be used include, but are not limited to, 1-isocyanato-4-[(4-isocyanatophenyl)methyl]benzene, 1-isocyanato-2-[(4-cyanatophenyl)methyl]benzene, bis(4-isocyanatocyclohexyl)methane, 5-isocyanato-1-(isocyanatomethyl)-1,3,3-trimethylcyclohexane, 1,3-diisocyanato-4-methyl-benzene, 2,2'-toluenediisocyanate, 2,4'-toluenediisocyanate, and mixtures thereof. Examples of specific polyisocyanate components include Mondur® ML (Bayer), Lupranate® MI (BASF), and Isonate® 50 O,P' (Dow Chemical), and combinations thereof.

A chain extender may be either water or a diamine chain extender for a polyurethaneurea. Combinations of different chain extenders may be included depending on the desired properties of the polyurethaneurea and the resulting fiber. Examples of suitable diamine chain extenders include: hydrazine; 1,2-ethylenediamine; 1,4-butanediamine; 1,2-butanediamine; 1,3-butanediamine; 1,3-diamino-2,2-dimethylbutane; 1,6-hexamethylenediamine; 1,12-dodecanediamine; 1,2-propanediamine; 1,3-propanediamine; 2-methyl-1,5-pentanediamine; 1-amino-3,3,5-trimethyl-5-aminomethylcyclohexane; 2,4-diamino-1-methylcyclohexane; N-methylamino-bis(3-propylamine); 1,2-cyclohexanediamine; 1,4-cyclohexanediamine; 4,4'-methylene-bis(cyclohexylamine); isophorone diamine; 2,2-dimethyl-1,3-propanediamine; meta-tetramethylxylenediamine; 1,3-diamino-4-methylcyclohexane; 1,3-cyclohexane-diamine; 1,1-methylene-bis(4,4'-diaminohexane); 3-aminomethyl-3,5,5-trimethylcyclohexane; 1,3-pentanediamine (1,3-diaminopentane); m-xylylene diamine; and Jeffamine® (Texaco).

When a polyurethane is desired, the chain extender is a diol. Examples of such diols that may be used include, but are not limited to, ethylene glycol, 1,3-propanediol, 1,2-propylene glycol, 3-methyl-1,5-pentanediol, 2,2-dimethyl-1,3-trimethylene diol, 2,2,4-trimethyl-1,5-pentanediol, 2-methyl-2-ethyl-1,3-propanediol, 1,4-bis(hydroxyethoxy) benzene, and 1,4-butanediol and mixtures thereof.

A blocking agent which is a monofunctional alcohol or a monofunctional dialkylamine may optionally be included to control the molecular weight of the polymer. Blends of one or more monofunctional alcohols with one or more dialkylamine may also be included.

Examples of monofunctional alcohols useful with the present invention include at least one member selected from the group consisting of aliphatic and cycloaliphatic primary and secondary alcohols with 1 to 18 carbons, phenol, substituted phenols, ethoxylated alkyl phenols and ethoxylated fatty alcohols with molecular weight less than about 750, including molecular weight less than 500, hydroxyamines, hydroxymethyl and hydroxyethyl substituted tertiary amines, hydroxymethyl and hydroxyethyl substituted heterocyclic compounds, and combinations thereof, including furfuryl alcohol, tetrahydrofurfuryl alcohol, N-(2-hydroxyethyl)succinimide, 4-(2-hydroxyethyl)morpholine, methanol, ethanol, butanol, neopentyl alcohol, hexanol, cyclohexanol, cyclohexanemethanol, benzyl alcohol, octanol, octadecanol, N,N-diethylhydroxylamine, 2-(diethylamino)ethanol, 2-dimethylaminoethanol, and 4-piperidineethanol, and combinations thereof.

Examples of suitable mono-functional dialkylamine blocking agents include: N,N-diethylamine, N-ethyl-N-propylamine, N,N-diisopropylamine, N-tert-butyl-N-methylamine, N-tert-butyl-N-benzylamine, N,N-dicyclohexylamine, N-ethyl-N-isopropylamine, N-tert-butyl-N-isopropylamine, N-isopropyl-N-cyclohexylamine, N-ethyl-N-cyclohexylamine, N,N-diethanolamine, and 2,2,6,6-tetramethylpiperidine.

Classes of additives that may be optionally included in polyurethane or polyurethaneurea compositions are listed below. An exemplary and non-limiting list is included. However, additional additives are well-known in the art. Examples include: anti-oxidants, UV stabilizers, colorants, pigments, cross-linking agents, phase change materials (paraffin wax), antimicrobials, minerals (i.e., copper), microencapsulated additives (i.e., aloe vera, vitamin E gel, aloe vera, sea kelp, nicotine, caffeine, scents or aromas), nanoparticles (i.e., silica or carbon), nano-clay, calcium carbonate, talc, flame retardants, antitack additives, chlorine degradation resistant additives, vitamins, medicines, fragrances, electrically conductive additives, dyeability and/or dye-assist agents (such as quaternary ammonium salts). Other additives which may be added to the polyurethaneurea compositions include adhesion promoters, anti-static agents, anti-creep agents, optical brighteners, coalescing agents, electroconductive additives, luminescent additives, lubricants, organic and inorganic fillers, preservatives, texturizing agents, thermochromic additives, insect repellents, and wetting agents, stabilizers (hindered phenols, zinc oxide, hindered amine), slip agents (silicone oil) and combinations thereof.

The additive may provide one or more beneficial properties including: dyeability, hydrophobicity (I.e., polytetrafluoroethylene (PTFE)), hydrophilicity (i.e., cellulose), friction control, chlorine resistance, degradation resistance (i.e., antioxidants), adhesiveness and/or fusibility (i.e., adhesives and adhesion promoters), flame retardance, antimicrobial behavior (silver, copper, ammonium salt), barrier, electrical conductivity (carbon black), tensile properties, color, luminescence, recyclability, biodegradability, fragrance, tack control (i.e., metal stearates), tactile properties, set-ability, thermal regulation (i.e., phase change materials), nutriceutical, delustrant such as titanium dioxide, stabilizers such as hydrotalcite, a mixture of huntite and hydromagnesite, UV screeners, and combinations thereof.

The surface speeds of the package, also referred to as the peripheral speed, as well as the threadline speed are maintained at a substantially constant rate, meaning without any intended variation. The speed may be selected at any desired rate such as about 250 meters/min to about 1400 meters/min; including about 450 meters/min to about 900 meters/min.

The features and advantages of the present invention are more fully shown by the following examples which are provided for purposes of illustration, and are not to be construed as limiting the invention in any way.

EXAMPLES

Helix Angle Variation Effect

Figure 3:
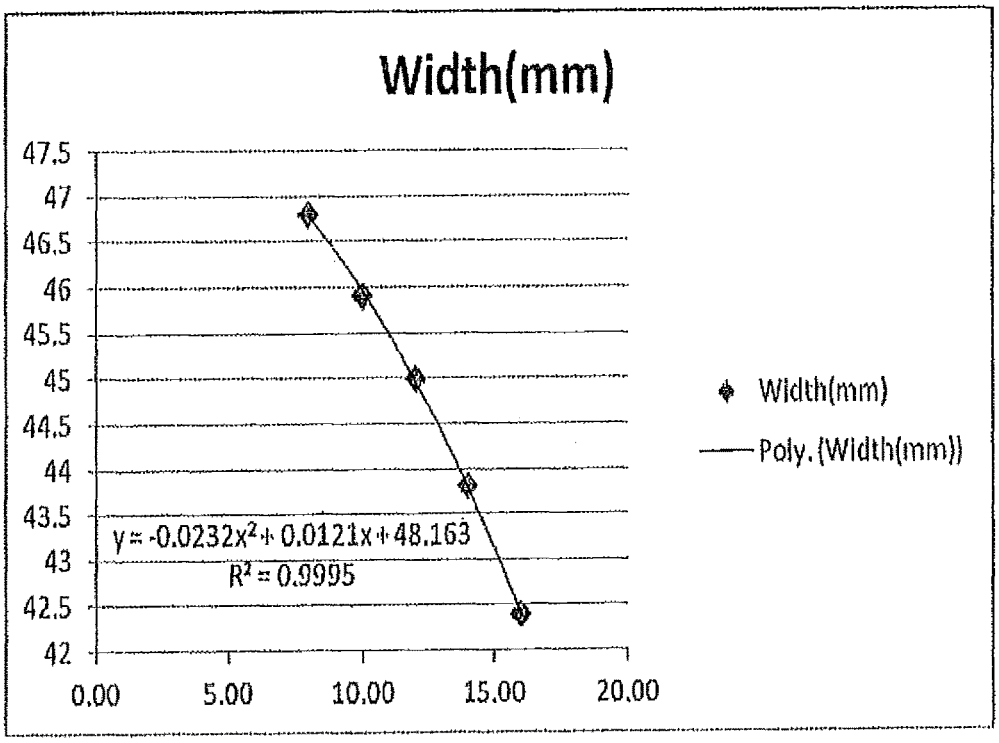
FIG. 3 is a plot of the resulting measured yarn laydown width.

The winding helix angle of 40 denier 2 filament spandex was changed over the following range. The resulting yarn laydown width was measured and plotted as shown in FIG. 3:

| Helix Angle | Yarn Laydown width(mm) |
|---|---|
| 8 | 46.8 |
| 10 | 45.9 |
| 12 | 45 |
| 14 | 43.8 |
| 16 | 42.4 |

At a typical helix angle of 12 degrees, with a standard helix angle variation of +/−2.5% (11.7-degrees to 12.3-degrees), the yarn laydown width will only slightly vary a total of 0.6-mm, from 45.3-mm to 44.7-mm. This is ineffective to sufficiently change the package shoulder shape and package flatness.

However, by increasing the helix angle variation to +/−20% (9.6-degrees to 14.4-degrees), the yarn laydown width will be substantially varied a total of 3.0-mm, from 46.5-mm to 43.5-mm. This amount of variation is very effective and sufficient to distribute the reversals, lower the shoulder and flatten the package.

Findings (Examples)

Test #1

Eight packages of 500 gram 40 denier 2 filament spandex were wound at different helix angle variation settings; control (+/−2.5%), and three tests (5%, 10% & 20%). The rate of helix angle variation (period of the variation) was held substantially proportional to the amplitude (2.5% in 9 seconds, 5% in 18 seconds, etc.). However, this could be varied as well and possibly needs further exploration for further improved effect.

These packages were then unwound on a standard Monarch circular knitting machine with standard Memminger unwind feeders at nominal speed of 40 meters per minute.

After unwinding 100 grams, running bands were most pronounced and were recorded and measured. A dramatic reduction in running bands was observed with increased helix angle variation; from fairly heavy on control (2.5%), less on 5% and 10%, and virtually none on 20%:

| Package type | Left shoulder | | | Right shoulder | | |
|---|---|---|---|---|---|---|
| | Number of packages with running bands | Running band average width (mm) | Running band average thickness (mm) | Number of packages with running bands | Running band average width (mm) | Running band average thickness (mm) |
| Control (2.5%) | 8 | 7.9 | 0.33 | 8 | 7.9 | 0.33 |
| 5% | 8 | 6.6 | 0.41 | 7 | 6.6 | 0.38 |
| 10% | 4 | 6.4 | 0.22 | 7 | 6.4 | 0.16 |
| 20% | 0 | — | — | 2 | 6.4 | 0.06 |

Test #2

A second test was conducted with finer yarn by winding 465 gram 20 denier 2 filament spandex packages at 2.5% (control), 10% and 20% helix variation. Three packages of each type were then unwound on a rolling unwind operating at a higher speed of 100 mpm. Running bands were counted at repeated points during the unwinding process with the following results:

| Package type | Total number of running bands (maximum is 6 of 6 shoulders) at package weight of: | | | | |
|---|---|---|---|---|---|
| | 425 g | 354 g | 280 g | 206 g | 120 g |
| Control (2.5%) | 2 | 4 | 3 | 2 | 0 |
| 10% | 2 | 1 | 0 | 0 | 0 |
| 20% | 0 | 0 | 0 | 0 | 0 |

Test #3 (Comparative)

A third test was conducted on heavy 620 denier spandex yarn. At 20% and even at 10% helix angle variation there was observed to be high numbers of reversals falling off of the edge of the package during winding. This adverse effect was not encountered with lighter denier spandex.

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

What is claimed is:

1. A method for winding a spandex yarn into a cylindrical substantially straight-ended yarn package comprising:

(a) feeding a spandex yarn at a substantially constant speed to a tube core to form said yarn package;

(b) rotating the yarn package to provide the yarn package with a substantially constant surface speed of 250 meters/min to about 1400 meters/min; and (c) winding the yarn at the substantially constant speed to form layers of helical coils while varying the helix angle of the yarn with respect to circumference of the yarn package from +/−20% up to +/−80% to increase variation in yarn laydown width and decrease running bands as compared to yarn wound at a helix angle of +/−2.5%.

2. The method of claim 1, wherein said winding includes a base angle of about 5° to about 30° from which the helix angle is applied.

3. The method of claim 1, wherein said winding includes a base angle of about 10° to about 15° from which the helix angle is applied.

4. The method of claim 1, wherein said helix angle variation provides a range of a helix angle of about 10° to about 20°.

5. The method of claim 1, wherein said helix angle variation provides a range of a helix angle of about 8° to about 18°.

6. The method of claim 1, wherein said yarn package includes a reduction in raised package shoulders compared to a yarn package including a zero helix angle variation.

7. The method of claim 1, wherein said elastic or elastomeric yarn has a linear density greater than zero and less than 620 denier.

8. The method of claim 1, wherein the surface speed of the yarn package is about 450 meters/min to about 900 meters/min.

* * * * *